US011097147B2

(12) United States Patent
Jones

(10) Patent No.: US 11,097,147 B2
(45) Date of Patent: Aug. 24, 2021

(54) WEIGHT PLATE WITH LIFTING FLANGES

(71) Applicant: Coulter Ventures, LLC., Columbus, OH (US)

(72) Inventor: Dylan Jones, Santa Barbara, CA (US)

(73) Assignee: Coulter Ventures, LLC., Columbus, OH (US)

( * ) Notice: Subject to any disclaimer, the term of this patent is extended or adjusted under 35 U.S.C. 154(b) by 0 days.

(21) Appl. No.: 16/701,549

(22) Filed: Dec. 3, 2019

(65) Prior Publication Data

US 2020/0171338 A1 Jun. 4, 2020

Related U.S. Application Data

(60) Provisional application No. 62/775,064, filed on Dec. 4, 2018.

(51) Int. Cl.
*A63B 21/072* (2006.01)
*A63B 21/06* (2006.01)

(52) U.S. Cl.
CPC ..... *A63B 21/072* (2013.01); *A63B 21/0604* (2013.01); *A63B 21/0607* (2013.01)

(58) Field of Classification Search
CPC .... A63B 21/072–0782; A63B 21/0604; A63B 21/4035; A63B 21/0607; A63B 21/4033; A63B 21/06–0607
See application file for complete search history.

(56) References Cited

U.S. PATENT DOCUMENTS 354,322 A 12/1886 Vodhanel, Jr.
355,007 A 12/1886 Rojas et al.
394,685 A 12/1888 Eckmann
405,484 A 6/1889 Rojas et al.
(Continued)

FOREIGN PATENT DOCUMENTS

CN 3191234 6/2001
CN 2512467 Y 9/2002
(Continued)

OTHER PUBLICATIONS

Product listing for CAP 12-sided Olympic Rubber Coated Grip Plate from <https://web.archive.org/web/20170621232634/http://capbarbell.com/cap-barbell-12-sided-2-rubber-grip-plate/>, dated Jun. 21, 2017.

(Continued)

*Primary Examiner* — Megan Anderson
*Assistant Examiner* — Kathleen Vermillera
(74) *Attorney, Agent, or Firm* — Banner & Witcoff, Ltd.

(57) ABSTRACT

A weightlifting apparatus includes a weight plate having a first side and an opposed second side. A central aperture extends through the weight plate. A pair of first slots extend through the weight plate. A first inner flange extends radially outwardly from an inner wall of each first slot on the first side of the weight plate. A first outer flange extends radially inwardly from an outer wall of each first slot on the second side of the weight plate. A pair of second slots extend through the weight plate. A second inner flange extends radially outwardly from an inner wall of each second slot on the second side of the weight plate. A second outer flange extends radially inwardly from an outer wall of each second slot on the first side of the weight plate.

22 Claims, 9 Drawing Sheets

(56) References Cited

U.S. PATENT DOCUMENTS

| | | | |
|---|---|---|---|
| 406,183 | A | 7/1889 | Zovich |
| 409,266 | A | 8/1889 | Rojas et al. |
| 409,695 | A | 8/1889 | Rojas et al. |
| 421,076 | A | 2/1890 | Lincir |
| 424,140 | A | 3/1890 | Lincir |
| 424,639 | A | 4/1890 | Rojas et al. |
| 428,947 | A | 5/1890 | Harms et al. |
| 433,468 | A | 8/1890 | Rojas et al. |
| 433,469 | A | 8/1890 | Rojas et al. |
| 433,720 | A | 8/1890 | Rojas et al. |
| 433,721 | A | 8/1890 | Rojas et al. |
| 434,090 | A | 8/1890 | Wallace et al. |
| 437,015 | A | 9/1890 | Rojas et al. |
| 439,290 | A | 10/1890 | Rojas et al. |
| 441,412 | A | 11/1890 | Rojas et al. |
| 441,812 | A | 12/1890 | Rojas et al. |
| 442,239 | A | 12/1890 | Rojas et al. |
| 442,240 | A | 12/1890 | Rojas et al. |
| 445,153 | A | 1/1891 | Lincir |
| 445,154 | A | 1/1891 | Lincir |
| 445,854 | A | 2/1891 | Harms et al. |
| 446,265 | A | 2/1891 | Lincir |
| 446,559 | A | 2/1891 | Lincir |
| 448,055 | A | 3/1891 | Lien et al. |
| 450,361 | A | 4/1891 | Harms et al. |
| 451,158 | A | 4/1891 | Lincir |
| 451,159 | A | 4/1891 | Rojas et al. |
| 451,160 | A | 4/1891 | Rojas et al. |
| 454,167 | A | 6/1891 | Lincir |
| 463,001 | A | 11/1891 | Buchanan |
| 474,517 | A | 5/1892 | Harms |
| 476,383 | A | 6/1892 | Chen |
| 483,083 | A | 9/1892 | Allshouse et al. |
| 502,514 | A | 8/1893 | Buchanan et al. |
| 516,639 | A | 3/1894 | Hamilton |
| 562,415 | A | 6/1896 | Xu et al. |
| 562,919 | A | 6/1896 | Hillson |
| 566,207 | A | 8/1896 | Cao |
| 566,208 | A | 8/1896 | Alessandri et al. |
| 566,209 | A | 8/1896 | Alessandri et al. |
| 568,423 | A | 9/1896 | Y'shua et al. |
| 572,320 | A | 12/1896 | Davies, III |
| 573,207 | A | 12/1896 | Davies, III |
| 573,208 | A | 12/1896 | Davies, III |
| 606,133 | A | 6/1898 | Lien |
| 615,605 | A | 12/1898 | Frasco et al. |
| 639,874 | A | 12/1899 | Hillson |
| 643,075 | A | 2/1900 | Childs |
| 662,558 | A | 11/1900 | Lovegrove et al. |
| 673,230 | A | 4/1901 | Qin |
| 684,224 | A | 10/1901 | Davies, III |
| 688,759 | A | 12/1901 | Davies, III |
| 722,348 | A | 3/1903 | Kessler |
| 749,177 | A | 1/1904 | Childs |
| 751,157 | A | 2/1904 | Irwin et al. |
| 777,266 | A | 12/1904 | Davies, III |
| 798,968 | A | 9/1905 | Lien |
| 1,033,056 | A | 7/1912 | Richert |
| 3,606,410 | A | 9/1971 | Inserra |
| 3,790,922 | A | 2/1974 | Normann |
| D279,495 | S | 7/1985 | Barbeau |
| D280,433 | S | 9/1985 | Lincir |
| D287,387 | S | 12/1986 | Oliver et al. |
| 4,639,979 | A | 2/1987 | Polson |
| 4,738,446 | A | 4/1988 | Miles |
| 4,773,641 | A | 9/1988 | Metz |
| 4,817,944 | A | 4/1989 | Anderson et al. |
| 4,893,810 | A | 1/1990 | Lee |
| D314,422 | S | 2/1991 | Adorjan |
| 5,033,740 | A | 7/1991 | Schwartz et al. |
| 5,108,066 | A | 4/1992 | Lundstrom |
| 5,137,502 | A | 8/1992 | Anastasi |
| 5,163,887 | A | 11/1992 | Hatch |
| D346,433 | S | 4/1994 | Cooper |
| D409,695 | S | 5/1999 | Rojas et al. |
| 6,014,078 | A | 1/2000 | Rojas et al. |
| D421,076 | S | 2/2000 | Lincir |
| D424,140 | S | 5/2000 | Lincir |
| D428,947 | S | 8/2000 | Harms et al. |
| D433,469 | S | 11/2000 | Rojas et al. |
| D433,720 | S | 11/2000 | Rojas et al. |
| D442,654 | S | 5/2001 | Buchanan |
| D445,153 | S | 7/2001 | Lincir |
| D445,154 | S | 7/2001 | Lincir |
| D445,854 | S | 7/2001 | Harms et al. |
| D446,265 | S | 8/2001 | Lincir |
| D446,559 | S | 8/2001 | Lincir |
| D448,055 | S | 9/2001 | Lien et al. |
| D450,361 | S | 11/2001 | Harms et al. |
| D451,158 | S | 11/2001 | Lincir |
| D451,159 | S | 11/2001 | Rojas et al. |
| 6,319,176 | B1 | 11/2001 | Landfair |
| D454,167 | S | 3/2002 | Lincir |
| 6,436,015 | B1 | 8/2002 | Frasco et al. |
| D474,517 | S | 5/2003 | Harms |
| D476,383 | S | 6/2003 | Chen |
| D480,969 | S | 10/2003 | Owens |
| D483,083 | S | 12/2003 | Allshouse et al. |
| 6,702,723 | B2 | 3/2004 | Landfair |
| 6,736,765 | B2 | 5/2004 | Wallace et al. |
| 6,746,380 | B2 | 6/2004 | Lien et al. |
| D494,451 | S | 8/2004 | Winig et al. |
| D496,414 | S | 9/2004 | Harms et al. |
| 6,837,833 | B2 | 1/2005 | Elledge |
| 6,875,161 | B1 | 4/2005 | Brice |
| D504,923 | S | 5/2005 | Harms et al. |
| D511,366 | S | 11/2005 | Brown |
| 6,991,590 | B2 | 1/2006 | Vigiano |
| D516,639 | S | 3/2006 | Hamilton |
| D519,584 | S | 4/2006 | Brice et al. |
| 7,198,591 | B2 | 4/2007 | Lien |
| 7,207,929 | B2 | 4/2007 | Hamilton |
| 7,300,389 | B2 | 11/2007 | Lien et al. |
| D562,919 | S | 2/2008 | Hillson |
| D566,209 | S | 4/2008 | Alessandri et al. |
| D573,208 | S | 7/2008 | Davies, III |
| 7,517,305 | B2 | 4/2009 | Lien |
| 7,625,322 | B1 | 12/2009 | Krull |
| D609,526 | S | 2/2010 | Tuttle |
| D611,524 | S | 3/2010 | Lawrence, III |
| 7,704,196 | B2 | 4/2010 | Lien et al. |
| D628,248 | S | 11/2010 | Januszek |
| 7,828,702 | B2 | 11/2010 | Lien et al. |
| D631,142 | S | 1/2011 | Angell |
| D637,697 | S | 5/2011 | Steiner |
| D639,874 | S | 6/2011 | Hinson |
| D660,928 | S | 5/2012 | Guarrasi |
| 8,282,138 | B2 | 10/2012 | Steiner |
| D673,230 | S | 12/2012 | Qin |
| D684,224 | S | 6/2013 | Davies, III |
| D692,969 | S | 11/2013 | Davies, III |
| D695,128 | S | 12/2013 | Ozsinmaz |
| D722,348 | S | 2/2015 | Kessler |
| D732,613 | S | 6/2015 | Davies, III |
| D736,884 | S | 8/2015 | Lovley, II et al. |
| 9,109,616 | B1 | 8/2015 | Ballentine |
| 9,126,077 | B2 | 9/2015 | Rothacker |
| D749,177 | S | 2/2016 | Childs |
| D749,889 | S | 2/2016 | Magistro |
| D751,157 | S | 3/2016 | Irwin et al. |
| D751,940 | S | 3/2016 | Vaughan et al. |
| 9,358,414 | B2 | 6/2016 | Dephouse |
| 9,364,704 | B1 | 6/2016 | Kuka |
| D763,658 | S | 8/2016 | Grasselli et al. |
| D764,608 | S | 8/2016 | Jones |
| D766,384 | S | 9/2016 | Jones |
| D771,205 | S | 11/2016 | Davies, III |
| 9,504,869 | B2 | 11/2016 | Gavigan |
| D777,266 | S | 1/2017 | Davies, III |
| D780,859 | S | 3/2017 | Ramsey et al. |
| D780,860 | S | 3/2017 | Jones |
| D780,861 | S | 3/2017 | Jones |
| D788,886 | S | 6/2017 | Salzer |
| 9,682,268 | B2 * | 6/2017 | Breitkreutz ..... A63B 21/0726 |

(56) References Cited

U.S. PATENT DOCUMENTS

| | | | | |
|---|---|---|---|---|
| D795,971 | S | 8/2017 | Patti | |
| D799,939 | S | 10/2017 | Lowitz | |
| D802,689 | S | 11/2017 | Lien | |
| D810,849 | S | 2/2018 | Chong | |
| D821,175 | S | 6/2018 | Grasselli et al. | |
| 10,005,317 | B2 | 6/2018 | Biderman et al. | |
| 10,040,259 | B2 | 8/2018 | Lister et al. | |
| 10,076,679 | B2 | 9/2018 | Dickerson | |
| D831,134 | S | 10/2018 | Hillson | |
| D834,115 | S | 11/2018 | Gilbert | |
| D842,399 | S | 3/2019 | Arceta | |
| D842,941 | S | 3/2019 | Brezovar | |
| D843,524 | S | 3/2019 | Henniger | |
| 10,226,659 | B2 | 3/2019 | Stilson | |
| D851,711 | S | 6/2019 | Brezovar | |
| D852,637 | S | 7/2019 | Becerra | |
| D854,636 | S | 7/2019 | Nelson | |
| D856,447 | S | 8/2019 | Dunahay | |
| D857,131 | S | 8/2019 | Marton et al. | |
| D861,809 | S | 10/2019 | Jones et al. | |
| D862,617 | S | 10/2019 | Henniger et al. | |
| 10,456,655 | B1 | 10/2019 | Orehek | |
| D865,881 | S | 11/2019 | Muir et al. | |
| 10,537,777 | B1 | 1/2020 | Tash et al. | |
| D896,901 | S | 9/2020 | Jones | |
| 10,773,117 | B1 | 9/2020 | Goldberg et al. | |
| 2002/0091044 | A1 | 7/2002 | Lien et al. | |
| 2003/0083179 | A1* | 5/2003 | Landfair | A63B 21/0601 482/93 |
| 2004/0077466 | A1* | 4/2004 | Wallace | A63B 21/072 482/93 |
| 2004/0092370 | A1* | 5/2004 | Lincir | A63B 21/072 482/107 |
| 2004/0166997 | A1 | 8/2004 | Vigiano | |
| 2005/0026754 | A1 | 2/2005 | Lien et al. | |
| 2006/0021154 | A1 | 2/2006 | Ha | |
| 2006/0073948 | A1 | 4/2006 | Lincir | |
| 2006/0211547 | A1* | 9/2006 | Lien | A63B 21/0728 482/93 |
| 2006/0240958 | A1 | 10/2006 | Liu | |
| 2006/0293155 | A1 | 12/2006 | Hamilton | |
| 2007/0013527 | A1 | 1/2007 | Sloan | |
| 2007/0027007 | A1 | 2/2007 | Frasco | |
| 2007/0135271 | A1 | 6/2007 | Lien et al. | |
| 2007/0138351 | A1 | 6/2007 | Wu | |
| 2007/0142188 | A1 | 6/2007 | Lien | |
| 2007/0184943 | A1 | 8/2007 | Davies | |
| 2008/0005026 | A1 | 1/2008 | Cross et al. | |
| 2008/0015367 | A1 | 1/2008 | Dobbins et al. | |
| 2008/0153678 | A1 | 6/2008 | McClusky | |
| 2008/0200316 | A1 | 8/2008 | Shillington | |
| 2008/0287271 | A1 | 11/2008 | Jones | |
| 2009/0048079 | A1 | 2/2009 | Nalley | |
| 2009/0118105 | A1 | 5/2009 | Schiff | |
| 2009/0192025 | A1 | 7/2009 | Minerva | |
| 2009/0239719 | A1 | 9/2009 | Patti | |
| 2009/0258766 | A1 | 10/2009 | Patti | |
| 2009/0270233 | A1 | 10/2009 | Cao | |
| 2010/0002235 | A1 | 1/2010 | Willing et al. | |
| 2010/0125030 | A1 | 5/2010 | Shifferaw | |
| 2011/0021327 | A1 | 1/2011 | Lien | |
| 2012/0094810 | A1 | 4/2012 | Anderson | |
| 2013/0165300 | A1 | 6/2013 | Richards | |
| 2014/0024504 | A1 | 1/2014 | Potts et al. | |
| 2014/0025652 | A1 | 1/2014 | Lew et al. | |
| 2014/0057764 | A1 | 2/2014 | Klukas | |
| 2014/0162850 | A1 | 6/2014 | Chen | |
| 2014/0274595 | A1 | 9/2014 | Patti | |
| 2015/0001136 | A1 | 1/2015 | Galloway McLean | |
| 2015/0023144 | A1 | 1/2015 | Chan et al. | |
| 2016/0175640 | A1 | 6/2016 | Kempton | |
| 2017/0011308 | A1 | 1/2017 | Sun et al. | |
| 2017/0149269 | A1 | 5/2017 | Rojas et al. | |
| 2017/0151460 | A1 | 6/2017 | Jennings et al. | |
| 2018/0002885 | A1 | 1/2018 | Sun et al. | |
| 2018/0272175 | A1 | 9/2018 | Henniger | |
| 2019/0011130 | A1 | 1/2019 | Shershnyov et al. | |
| 2019/0014374 | A1 | 1/2019 | Kunkel | |
| 2019/0023210 | A1 | 1/2019 | Iverson et al. | |
| 2019/0038927 | A1 | 2/2019 | Wilhelm et al. | |
| 2019/0299047 | A1 | 10/2019 | Nalley | |
| 2019/0388723 | A1 | 12/2019 | Nalley et al. | |
| 2020/0036075 | A1 | 1/2020 | Ding et al. | |
| 2020/0038430 | A1 | 2/2020 | Glass et al. | |
| 2020/0376320 | A1 | 12/2020 | Wang | |

FOREIGN PATENT DOCUMENTS

| | | |
|---|---|---|
| CN | 303340060 | 8/2015 |
| CN | 303896560 | 10/2016 |
| CN | 304438760 | 1/2018 |
| CN | 305524546 | 12/2019 |
| EM | 003110402-0001 | 7/2016 |
| EM | 007065669-0001 | 10/2019 |
| ES | 1038081 U | 5/1998 |

OTHER PUBLICATIONS

Product listing for Rogue 6-Shooter Urethane Olympic Grip Plates from <https://web.archive.org/web/20170714033025/http://www.roguefitness.com:80/rogue-6-shooter-urethane-olympic-grip-plates>, dated Jul. 14, 2017.

CAP Barbell Weight Plates listing from <https://web.archive.org/web/20180103173524/http://capbarbell.com/strength/weight-plates>, dated Jan. 3, 2018.

BodyRip Premium Pro (2 x 10kg) Olympic-Grip Rubber Plates: Published Mar. 24, 2014 [online], site visited Dec. 1, 2019, Available from Internet URL: https://www.amazon.co.uk/dp/B00J7S8ZGC/ref=cm_sw_r_tw_dp_U_x_Xof5DbXRFZ5AC (Year: 2014).

Viavito Tri Grip Vinyl Standard Weight Plates: Published Mar. 17, 2016 [online], site visited Dec. 1, 2019. Available from Internet URL: https://www.amazon.co.uk/dp/B01D3U5RXI/ref=cm_sw_r_tw_dp_U_x_epf5Db1B78TVQ (Year: 2016).

Bodypower 10kg Tri Grip Vinyl Standard (1 Inch) Weight Disc Plates: Published Jun. 10, 2013 [online], site visited Dec. 1, 2019. Available from Internet URL: https://www.amazon.co.uk/dp/B00E4WH2NS/ref=cm_sw_r_tx_dp_U_x_Fpf5DbMHT60MN (Year: 2013).

BodyRip Olympic Polygonal Weight Plates: Published Feb. 3, 2015 [online], site visited Dec. 1, 2019. Available from Internet URL: https://www.amazon.co.uk/dp/B00T4GM5W2/ref=cm_sw_r_tw_dp_U_x_ASg5DbMR69J5P (Year: 2015).

BodyRip Polygonal Weight Plates 1 x 10kg BodyRip: Published Feb. 7, 2014 [online], site visited Dec. 1, 2019. Available from Internet URL: https://www.amazon.co.uk/dp/B00IARQAWW/ref=cm_sw_r_tw_dp_U_x_51f5DbXR685AX (Year 2014).

Mar. 10, 2020 (WO) International Search Report & Written Oppinion PCT/US2019/064237.

Ignite by Spri Weight Plates: Published 2017[online], site visited Dec. 1, 2019. Available from Internet URL: https://www.amazon.com/dp/B001F1Y1G/ref=cm_sw_r_tw_dp_U_x_MSN7DbQ7T67HB (Year: 2017).

Body Solid Rubber Grip Olympic Weight Plates (ORST255) Bodysolid: Published Feb. 2, 2009tonlinel, site visited Dec. 1, 2019. Available from Internet URL: https://www.amazon.com/dp/B001FIY17C/ref=cm_sw_r_tw_dp_U_x_MSN7DbQ7T67H8 (Year: 2009).

Product listing for 2" Deep Dish Olympic Weight Plates, from <https://yorkbarbell.com/product/deep-dish-olympic-plate/>, dated Jul. 7, 2020.

Product listing for Apollo Athletics Deep Dish Olympic Plates, from https://www.showmeweights.com/apollo-athletics-deep-dish-olympic-plates.html <https://protect-us.mimecast.com/s/Z5b_CqxAjoHOYJDOFXM5uD>, dated Jul. 7, 2020.

Photo of Olympic Standard Barbell Weight Plates, from https://www.picclickimg.com/d/l400/pict/132810172419_/Olympic-Standard-Barbell-Vintage-Deep-Dish-Weight-Plates.jpg <https://protect-us.mimecast.com/s/5TrHCrkg0piAQ4pVs4gvnb>, dated Jul. 7, 2020.

(56) References Cited

OTHER PUBLICATIONS

Product listing for 2" Hole Olympic Weights and Hampton Olympic Bars, from <https://www.google.com/url?sa=i&url=http%3A%2F%2Fwww.shoppok.com%2Ftoledo%2Fa%2C39%2C138616%2C2-hole-Olympic-Weights-and-Hampton-Olympic-bars—Ypsilanti-mi-48197-.htm&psig =AOvVaw1beW0Nv1j4xfi64WvSomVK&ust=1592656917597000&source=images&cd=vfe&ved=0CAIQJRxqFwoTCMDE38HzjeoCFQAAAAAdAAAAABAJ>, dated Jul. 7, 2020.

Photo of York Olympic Standard Barbell Weight Plates, from https://external-preview.redd.it/GelL3ODNpQ8Rv7Xu1vfzNyPzFSSdljn9crrZ4i5T5-4.jpg?auto=webp&s=d87da24a6c3837e0e90f9c88b366c7781fb9f150 <https://protect-us.mimecast.com/s/Bj3xCwpnjxULIg78f1C5tl>, dated Jul. 7, 2020.

A Guide to Buying Steel Powerlifting Plates & Discs, from https://www.garage-gyms.com/steel-powerlifting-weight-plates-discs-guide-review/<https://protect-us.mimecast.com/s/KyYQCxkoGyiJEPyMcW6mod/>, dated Nov. 16, 2017.

Photo of York Barbell Weight Plates, from https://i.ebayimg.com/00/s/OTQzWDE2MDA=/z/FkEAAOSwi~deOkZf/$_3.JPG?set_id=8800005007 <https://protect-us.mimecast.com/s/73a3CyPp8zHNOAgXfPXDcQ>, dated Jul. 7, 2020.

Photo of York Olympic Standard Barbell Weight Plate, from https://www.picclickimg.com/d/l400/pict/162970072869_/245-lbs-Vintage-Deep-Dish-York-made-in-USA-Olympic.jpg <https://protect-us.mimecast.com/s/H0JXCzpqmAURWO3gSMDmbC>, dated Jul. 7, 2020.

Screen capture of Rogue Elephant Bar Deadlift—Full Live Stream | Arnold Strongman Classic 2020, from <https://www.youtube.com/watch?v=CuYsT9GeUmc&feature=emb_rel_pause>, dated Mar. 7, 2020.

Cap barbell , announced 2015 [online] [site visited Dec. 23, 2020]. Available from internet, URL: https://www.amazon.com/CAP-Barbell-Olympic-Sided-Single/dp/B00XP89NUW/ref=sr_1_67?dchild=1&keywords=OLYMPIC+WEIGHT+PLATE&qid=160875628&sr=8-67 (Year: 2015).

Ader sporting goods Olympic plate, announced 2013 [online], [site visited Dec. 21, 2020]. Available from internet, URL: https//www.amazon.com/Olympic-Plate-Machine-Finished-Pair/dp/B00D4YOPR8/ref=sr_1_90? dchild=1&keywords=CAP%2BWEIGHT%2BPLATE&qid=1608582870&sr=8-90&th=1&psc=1 (Year: 2013).

Cap barbell 45 lb gray olympic weight plate, announced 2017 [online], [site visited Dec. 21, 2020]. Available from internet, URL: https://www.amazon.com/CAP-Barbell-Olympic-Weight-Single/dp/B003070MZI/ref=sr_1_23?dchild=1&keywords=ROGUE+WEIGHT+PLATE&qid=1608582701&sr=8-23 (Year: 2017).

* cited by examiner

WEIGHT PLATE WITH LIFTING FLANGES

CROSS-REFERENCE TO RELATED APPLICATIONS

This application claims benefit to U.S. Provisional Application No. 62/775,064, filed on Dec. 4, 2018, which is incorporated herein by reference in its entirety.

FIELD

Aspects of this disclosure relate generally to a weight plate for weightlifting, and more particularly, to a weight plate with flanges to facilitate lifting of the weight plate.

BACKGROUND

Weight plates are often used in weightlifting in combination with bars and weightlifting machines. The weight plates may be disc-shaped and include a central aperture that receives the bar. The weight plates may be secured to the bar with a retention collar that retains the weight plate on the bar.

Weight plates can be difficult to pick up, particularly if they have flat sides. Most users can typically pick up lighter weight plates without too much difficulty. However, larger and heavier weight plates can present problems for users. A flat sided weight plate cannot be easily lifted off a flat surface, such as a floor, or a stack of weight plates. In order to lift the weight plate off of a flat surface, the user may try to grasp the periphery or outer edge of the weight plate to lift one side of the weight plate, insert their fingers beneath the lifted edge, and then grasp and lift the weight plate. This can be difficult with heavy weight plates. It is to be appreciated that the user may drop a weight plate that they are trying to lift in this manner if it slips out of their grasp, which could result in injury to the user, or others. It can also be difficult for a user to carry a large weight plate when moving it to mount onto a bar or onto a weightlifting machine.

Another potential for injury comes into play when loading weight plates onto a bar or a weightlifting machine. To load weight plates onto a bar, the user may grasp the weight plate about its peripheral edge, and then position the weight plate on the bar such that the bar slides through the central aperture in the weight plate. The user may then push the weight plate along the bar until it contacts a bar stop or other weight plates already positioned on the bar. Often, the force used by the user may exceed that needed to move the weight plate along the bar, in which case the user's fingers may get pinched between the weight plate and previously loaded weight plates.

It would be desirable to provide a weight plate that can easily be lifted and manipulated by a user, and that reduces or overcomes some or all of the difficulties inherent in prior known devices. Particular objects and advantages will be apparent to those skilled in the art, that is, those who are knowledgeable or experienced in this field of technology, in view of the following disclosure and detailed description of certain embodiments.

SUMMARY

In accordance with a first aspect, a weightlifting apparatus includes a weight plate having a first side and an opposed second side. A central aperture extends through the weight plate from the first side to the second side. A pair of first slots extend through the weight plate from the first side to the second side, wherein the central aperture is positioned between the first slots. A first inner flange extends radially outwardly from an inner wall of each first slot on the first side of the weight plate. A first outer flange extends radially inwardly from an outer wall of each first slot on the second side of the weight plate. A pair of second slots extend through the weight plate from the first side to the second side, wherein the central aperture is positioned between the second slots. A second inner flange extends radially outwardly from an inner wall of each second slot on the second side of the weight plate. A second outer flange extends radially inwardly from an outer wall of each second slot on the first side of the weight plate.

In accordance with another aspect a weightlifting apparatus includes a weight plate formed of urethane and having a first side and an opposed second side. A central aperture extends through the weight plate. A metal insert is received in the central aperture and has an insert aperture extending therethough. A pair of opposed first slots extend through the weight plate. A first inner flange extends radially outwardly from an inner wall of each first slot on the first side of the weight plate. A first outer flange extends radially inwardly from an outer wall of each first slot on the second side of the weight plate. A pair of opposed second slots extend through the weight plate. A second inner flange extends radially outwardly from an inner wall of each second slot on the second side of the weight plate. A second outer flange extends radially inwardly from an outer wall of each second slot on the first side of the weight plate.

These and additional features and advantages disclosed here will be further understood from the following detailed disclosure of certain embodiments, the drawings thereof, and from the claims.

BRIEF DESCRIPTION OF THE DRAWINGS

The foregoing and other features and advantages of the present embodiments will be more fully understood from the following detailed description of illustrative embodiments taken in conjunction with the accompanying drawings in which.

Figure 1:
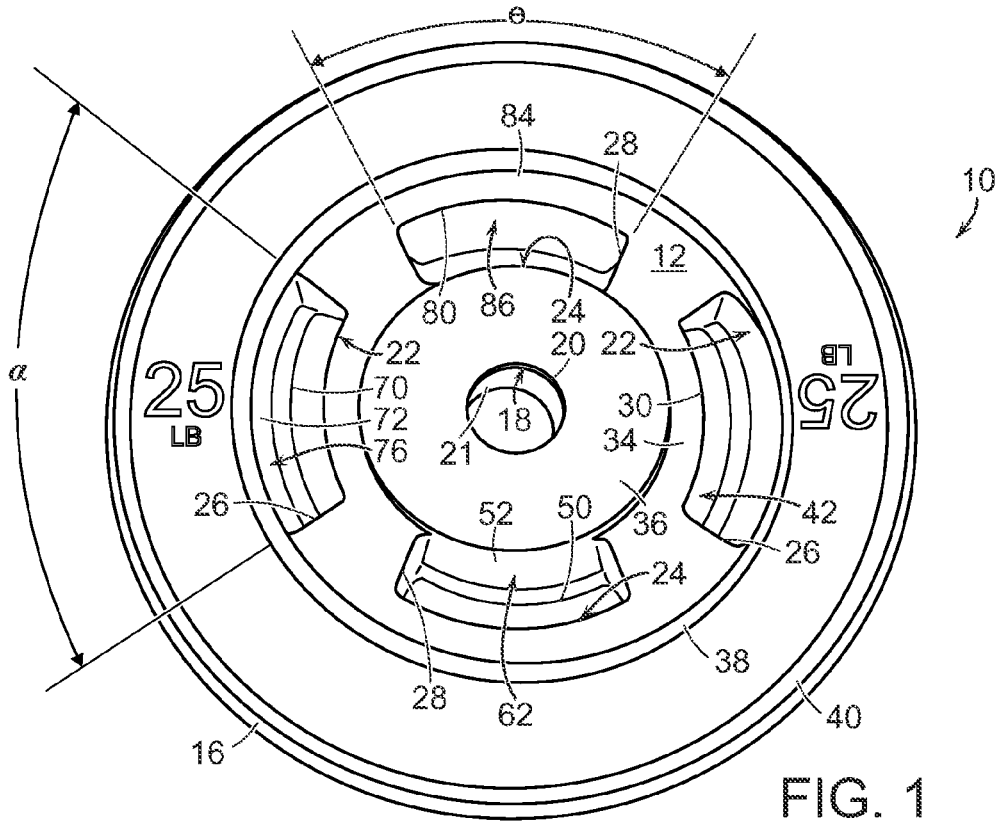
FIG. 1 is a perspective view of a first side of a weight plate.

The figures referred to above are not drawn necessarily to scale, should be understood to provide a representation of particular embodiments, and are merely conceptual in nature and illustrative of the principles involved. Some features of the weight plate depicted in the drawings have been enlarged or distorted relative to others to facilitate explanation and understanding. The same reference numbers are used in the drawings for similar or identical components and features shown in various alternative embodiments. Weight plates as disclosed herein would have configurations and components determined, in part, by the intended application and environment in which they are used.

DETAILED DESCRIPTION OF EMBODIMENTS

In the following description of various example structures in accordance with the disclosure, reference is made to the accompanying drawings, which form a part hereof, and in which are shown by way of illustration of various structures in accordance with the disclosure. Additionally, it is to be understood that other specific arrangements of parts and structures may be utilized, and structural and functional modifications may be made without departing from the scope of the present disclosure. Also, while spatial terms such as "top", "bottom", rear, front, vertical, and the like may be used in this specification to describe various example features and elements of the disclosure, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this disclosure.

Figure 2:
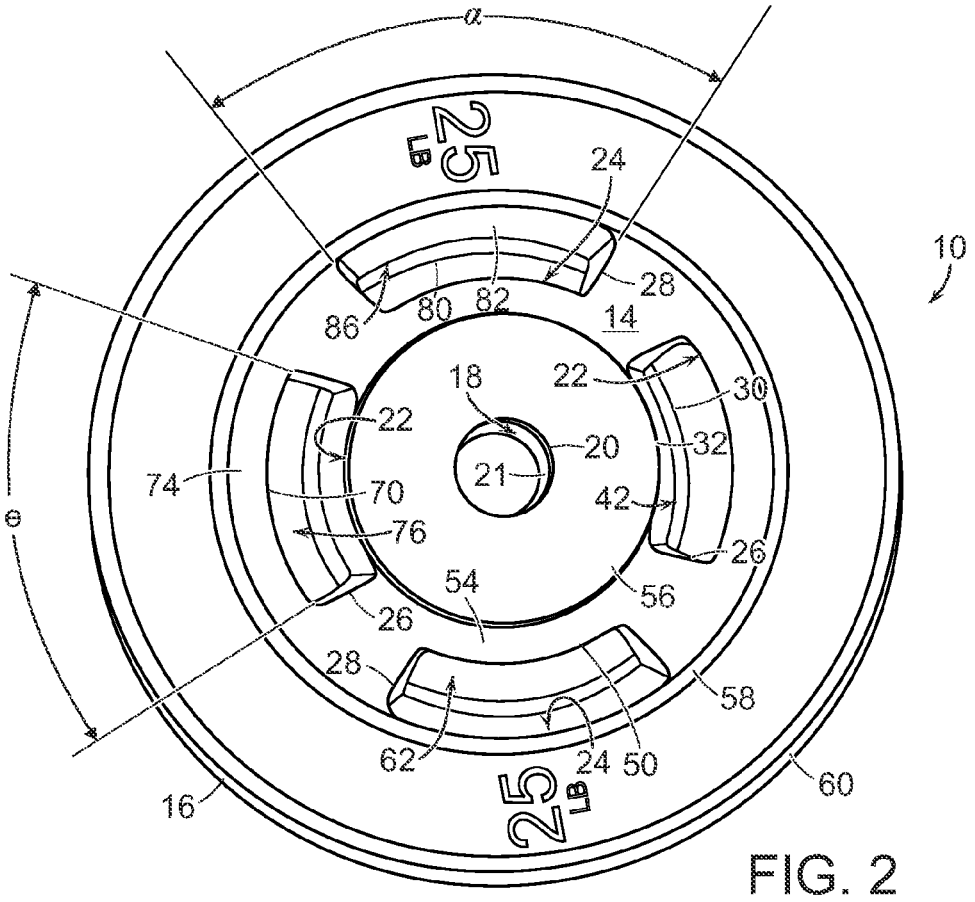
FIG. 2 is a perspective view of a second side of the weight plate of FIG. 1.

Referring to FIGS. 1-5A, a weight plate 10 is shown having a first side 12 (visible in FIG. 1) and an opposed second side 14 (visible in FIG. 2). In the illustrated embodiment, weight plate 10 has a peripheral edge 16 that is circular in shape. It is to be appreciated that in other embodiments peripheral edge 16 may have other shapes, as discussed in greater detail below.

Weight plate 10 may have a central aperture 18 extending therethrough. In certain embodiments, an insert 20 may be received in central aperture 18. A central or insert aperture 21 may extend through insert 20. Insert aperture 21 may be configured to receive a bar (not shown) used for weightlifting, such as the end of a barbell. Weight plate 10 may be formed of a first material or materials while insert 20 may be formed of a different second material.

Weight plate 10 may be formed of iron or steel, for example. In the case of a metal weight plate, an insert 20 may or may not be used. In other embodiments, weight plate 10 may be made partially or completely of polyurethane, urethane, or rubber, for example. When weight plate 10 is made at least partially of polyurethane, urethane, or rubber, insert 20 may be formed of a metal, such as steel or cast iron, for example.

A pair of opposed first slots 22 are formed in and extend through weight plate 10 on opposite sides of the central aperture 18. A pair of opposed second slots 24 are formed in and extend through weight plate 10 on opposite sides of the central aperture 18. Second slots 24 are offset 90° from first slots 22 with respect to the central aperture 18. In the embodiment of FIGS. 1-2, the first slots 22 are symmetrical to each other relative to the central aperture 18, and the second slots 24 are also symmetrical to each other relative to the central aperture 18.

First slots 22 and second slots 24 are positioned radially outwardly of central aperture 18 and radially inwardly of peripheral edge 16. In certain embodiments, first slots 22 and second slots 24 positioned approximately midway between central aperture 18 and peripheral edge 16. Each first slot 22 has an inner wall 32 and an outer wall 72 positioned radially outward from the inner wall 32, and each second slot 24 has an inner wall 52 and an outer wall 82 positioned radially outward from the inner wall 52.

In the illustrated embodiment, first slots 22 and second slots 24 are curved, or arcuate slots. The inner walls 32, 52 and the outer walls 72, 82 of the first and second slots 22, 24 are curved or arcuate in this configuration. First slots 22 may extend along an arc having a central angle $\alpha$ on first side 12 and a central angle $\Theta$ on second side 14, while second slots may extend along an arc having central angle $\alpha$ on second side 14 and central angle $\Theta$ on first side 12. In certain embodiments, central angle $\alpha$ may be between approximately 70° and approximately 90°, and, more particularly, approximately 83°, while central angle $\Theta$ may be between approximately 30° and approximately 45°, and, more particularly, approximately 37°.

Ends 26 of each of first slots 22 and ends 28 of each of second slots 24 may extend radially along weight plate 10.

The term "approximately" as used herein is meant to mean close to, or about a particular value, within the constraints of sensible commercial engineering objectives, costs, manufacturing tolerances, and capabilities in the field of weight plate manufacturing and use. Similarly, the term "substantially" as used herein is meant to mean mostly, or almost the same as, within the constraints of sensible commercial engineering objectives, costs, manufacturing tolerances, and capabilities in the field of weight plate manufacturing and use.

A first inner flange 30 may extend radially outwardly from and along the inner wall 32 of each first slot 22 on first side 12 of weight plate 10. In certain embodiments, an outer surface 34 of each first inner flange 30 may be flush with at least a portion of first side 12 of weight plate 10. In the illustrated embodiment, outer surfaces 34 of first inner flanges 30 are flush with a portion of first side 12 of weight plate 10 that is circumferentially adjacent to ends 26 of first slots 22.

In the illustrated embodiment, first inner flange 30 extends along an entirety of inner wall 32 of first slot 22. It is to be appreciated that in other embodiments, first inner flange 30 could extend along less than the entire length of inner wall 32.

A first central hub 36 may be positioned about central aperture 18, and may project or extend axially outwardly from the surface of first side 12. A first inner peripheral rib 38 may be positioned on first side 12 radially outwardly of first slots 22 and second slots 24. First inner peripheral rib 38 may project or extend axially outwardly from the surface of first side 12. A first outer peripheral rib 40 may be positioned on first side 12 along peripheral edge 16 and project or extend axially outwardly from the surface of first side 12.

First inner flange 30 is spaced toward first side 12 from second side 14. The extension of each first inner flange 30 from inner wall 32 of a first slot 22 defines a first inner recess 42 beneath first inner flange 30. A user may insert their fingers beneath first inner flange 30 into first inner recess 42 so that they can grasp, lift, and hold weight plate 10 when second side 14 is resting against a surface (e.g., the ground). As shown in FIG. 1, a user can simultaneously insert the fingers of both hands under both first inner flanges 30 into first inner recesses 42 so that they can lift weight plate 10 with both hands, which may be necessary for heavier weight plates.

Figure 10:
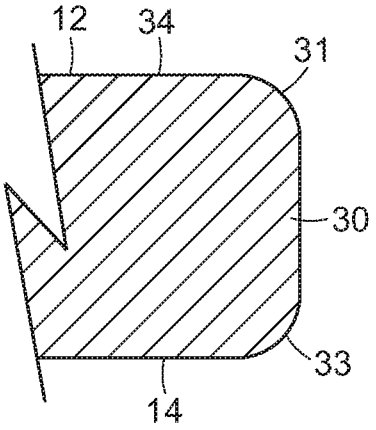
FIG. 10 is a sectional view of a portion of a first inner flange of the weight plate of FIG. 1.

In certain embodiments, as illustrated in FIG. 10, first inner flange 30 may be rounded over at a first edge 31 where it meets with first side 12, and at a second edge 33 where it meets with second side 14 in order to make it more comfortable on the fingers of the user when they insert their fingers beneath first inner flange 30 and grasp weight plate 10.

Similarly, a second inner flange 50 may extend radially outwardly from and along the inner wall 52 of each second slot 24 on second side 14 of weight plate 10. In certain embodiments, an outer surface 54 of each second inner flange 50 may be flush with at least a portion of second side 14 of weight plate 10. In the illustrated embodiment, outer surfaces 54 of second inner flanges 50 are flush with a portion of second side 14 of weight plate 10 that is circumferentially adjacent to ends 28 of second slots 24.

In the illustrated embodiment, second inner flange 50 extends along an entirety of inner wall 52 of second slot 24. It is to be appreciated that in other embodiments, second inner flange 50 could extend along less than the entire length of inner wall 52.

A second central hub 56 may be positioned about central aperture 18, and may project or extend axially outwardly from the surface of second side 14. A second inner peripheral rib 58 may be positioned on second side 14 radially outwardly of first slots 22 and second slots 24. Second inner peripheral rib 58 may project or extend axially outwardly from the surface of second side 14. A second outer peripheral rib 60 may be positioned on second side 14 along peripheral edge 16 and project or extend axially outwardly from the surface of second side 14.

Second inner flange 50 is spaced toward second side 14 from first side 12. The extension of each second inner flange 50 from inner wall 52 of a second slot 24 defines a second inner recess 62 beneath second inner flange 50. A user may insert their fingers beneath second inner flange 50 into second inner recess 62 so that they can grasp, lift, and hold weight plate 10 when first side 12 is resting against a surface (e.g., the ground). As shown in FIG. 2, a user can simultaneously insert the fingers of both hands under both second inner flanges 50 into second inner recesses 62 so that they can lift weight plate 10 with both hands, which may be necessary for heavier weight plates.

Figure 11:
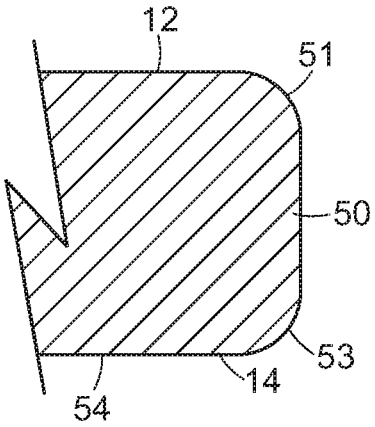
FIG. 11 is a sectional view of a portion of a second inner flange of the weight plate of FIG. 1.

In certain embodiments, as illustrated in FIG. 11, second inner flange 50 may be rounded over at a first edge 51 where it meets with first side 12, and at a second edge 53 where it meets with second side 14 in order to make it more comfortable on the fingers of the user when they insert their fingers beneath second inner flange 50 and grasp weight plate 10.

A first outer flange 70 may extend radially inwardly from and along the outer wall 72 of each first slot 22 on second side 14 of weight plate 10. In certain embodiments, an outer surface 74 of each first outer flange 70 may be flush with at least a portion of second side 14 of weight plate 10. In the illustrated embodiment, outer surfaces 74 of first outer flanges 70 are flush with a portion of second side 14 of weight plate 10 that is circumferentially adjacent to ends 26 of first slots 22.

In the illustrated embodiment, first outer flange 70 extends along an entirety of outer wall 72 of first slot 22. It is to be appreciated that in other embodiments, first outer flange 70 could extend along less than the entire length of outer wall 72.

First outer flange 70 is spaced toward second side 14 from first side 12. The extension of each first outer flange 70 from outer wall 72 of a first slot 22 defines a first outer recess 76 beneath first outer flange 70. A user may insert their fingers beneath first outer flange 70 into first outer recess 76 so that they can grasp, lift, and hold weight plate 10 when first side 12 is resting against a surface (e.g., the ground).

Figure 12:
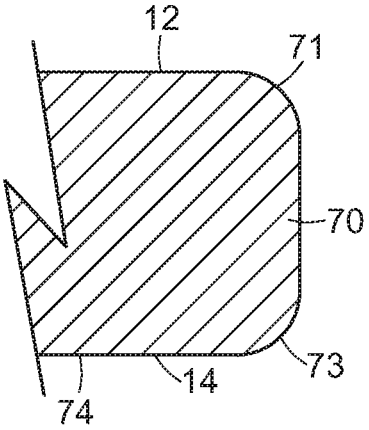
FIG. 12 is a sectional view of a portion of a first outer flange of the weight plate of FIG. 1.

In certain embodiments, as illustrated in FIG. 12, first outer flange 70 may be rounded over at a first edge 71 where it meets with first side 12, and at a second edge 73 where it meets with second side 14 in order to make it more comfortable on the fingers of the user when they insert their fingers beneath first outer flange 70 and grasp weight plate 10.

Similarly, a second outer flange 80 may extend radially inwardly from and along the outer wall 82 of each second slot 24 on first side 12 of weight plate 10. In certain embodiments, an outer surface 84 of each second outer flange 80 may be flush with at least a portion of first side 12 of weight plate 10. In the illustrated embodiment, outer surfaces 84 of second outer flanges 80 are flush with a portion of first side 12 of weight plate 10 that is circumferentially adjacent to ends 28 of second slots 24.

In the illustrated embodiment, second outer flange 80 extends along an entirety of outer wall 82 of second slot 24. It is to be appreciated that in other embodiments, second outer flange 80 could extend along less than the entire length of outer wall 82.

Second outer flange 80 is spaced toward first side 12 from second side 14. The extension of each second outer flange 80 from outer wall 82 of a second slot 24 defines a second outer recess 86 beneath second outer flange 80. A user may insert their fingers beneath second outer flange 80 into second outer recess 86 so that they can grasp, lift, and hold weight plate 10 when second side 14 is resting against a surface (e.g., the ground).

Figure 13:
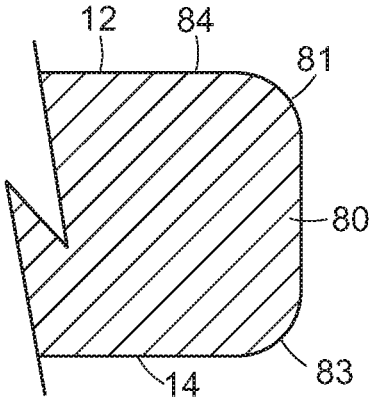
FIG. 13 is a sectional view of a portion of a second outer flange of the weight plate of FIG. 1.

In certain embodiments, as illustrated in FIG. 13, second outer flange 80 may be rounded over at a first edge 81 where it meets with first side 12, and at a second edge 83 where it meets with second side 14 in order to make it more comfortable on the fingers of the user when they insert their fingers beneath second outer flange 80 and grasp weight plate 10.

Figure 3:
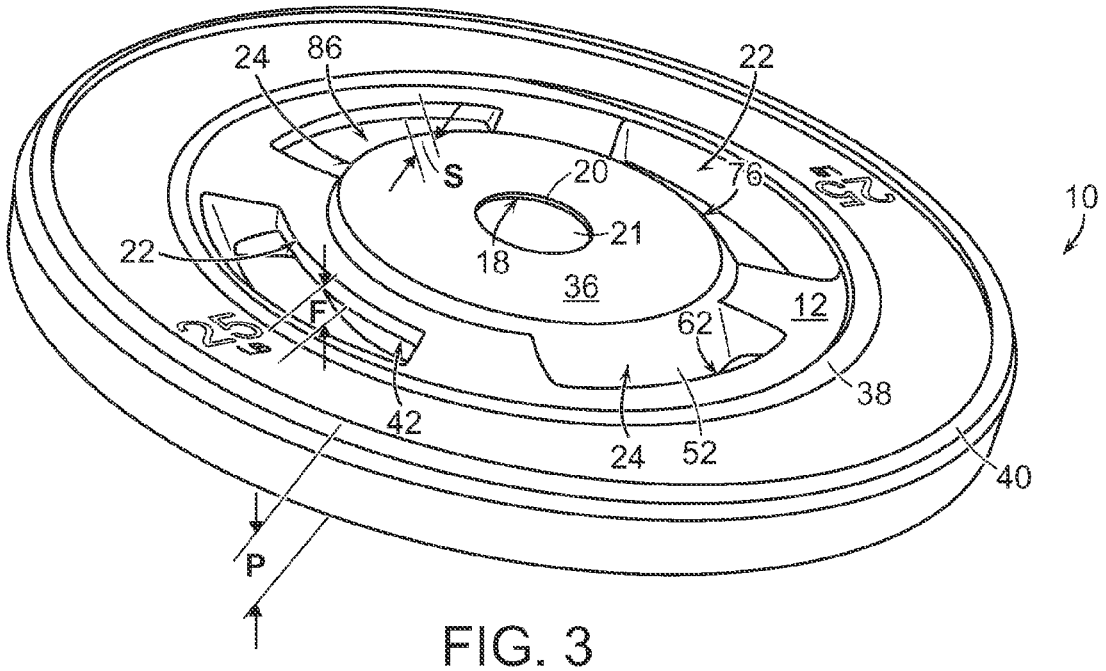
FIG. 3 is another perspective view of the first side of the weight plate of FIG. 1 showing a thickness of the weight plate and a flange of the weight plate.

As shown in FIG. 3, weight plate 10 may have a maximum axial thickness P, while first and second inner flanges 30, 50 may have an axial thickness F, and first and second outer flanges 70, 80 may have an axial thickness S. In certain embodiments thickness P may be between approximately 1" and approximately 3.75". Thickness F, which is less than thickness P, may be between approximately 0.15" and approximately 0.45", and, more particularly, approximately 0.30". Thickness S, which is less than thickness P, may be between approximately 0.75" and approximately 2.75", and, more particularly, approximately 1.75".

Figure 4:
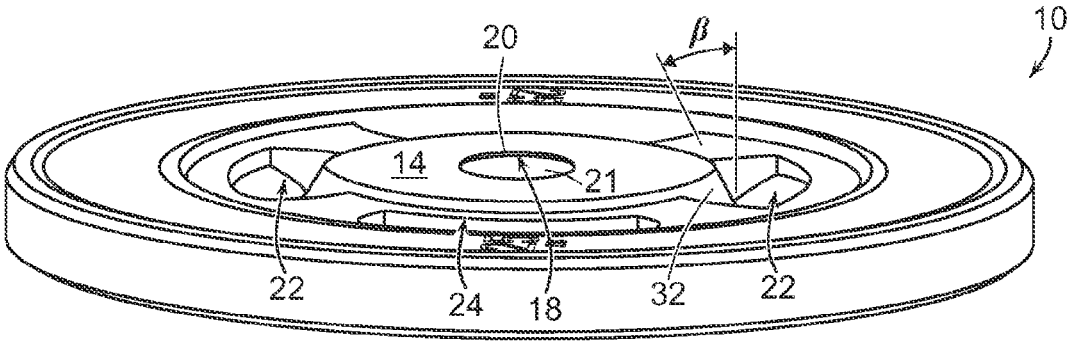
FIG. 4 is another perspective view of the second side of the weight plate of FIG. 1.

In certain embodiments, as shown in FIG. 4, inner walls 32 of first slots 22 may be sloped radially inwardly from first side 12 toward second side 14 at an angle β. In certain embodiments, angle β may be between approximately 10° and approximately 50°, and, more particularly, approximately 30°. The sloping of inner walls 32 expands first slots 22 to facilitate the user being able to easily insert their fingers beneath first outer flanges 70 and into first outer recesses 76. Similarly, inner wall 52 of second slot 24 may be sloped radially inwardly from second side 14 toward first side 12 at the same angle β, allowing the user to easily insert their fingers beneath second outer flanges 80 and into second outer recesses 86. It is understood that "sloped" does not require that the inner walls 32, 52 are flat surfaces, but only that the walls 32, 52 extend both radially and axially. In the embodiments of FIGS. 1-9, the inner walls 32 of the first slots 22 are sloped with respect to the first and second sides 12, 14 to extend radially outward and axially from the second side 14 to the first inner flanges 30, and the inner walls 52 of the second slots 24 are sloped with respect to the first and second sides 12, 14 to extend radially outward and axially from the first side 12 to the second inner flanges 50.

Figure 5:
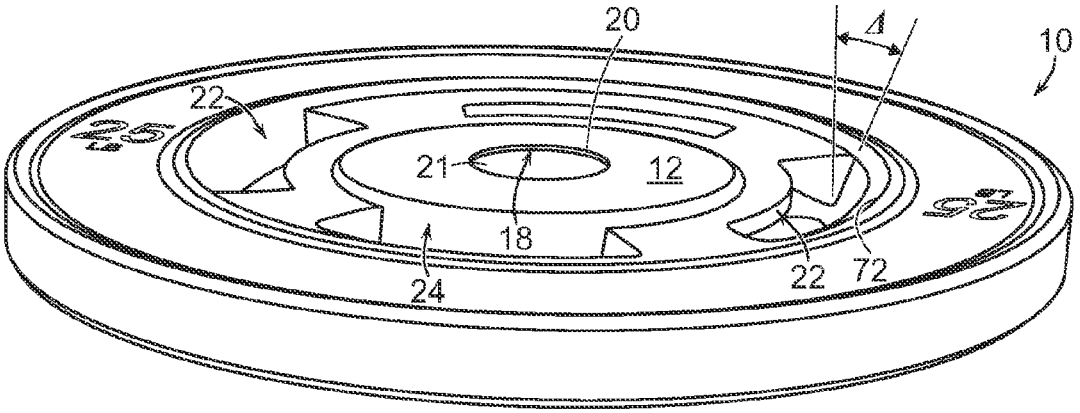
FIG. 5 is another perspective view of the first side of the weight plate of FIG. 1.

In certain embodiments, as shown in FIG. 5, outer wall 72 of first slot 22 may be sloped radially inwardly from first side 12 toward second side 14 at an angle Δ. In certain embodiments, angle Δ may be between approximately 10° and approximately 50°, and, more particularly, approximately 30°. The sloping of outer wall 72 expands first slot 22 to facilitate the user being able to easily insert their fingers beneath first inner flanges 30 and into first inner recesses 42. Outer wall 82 of second slot 24 may be sloped radially inwardly from second side 14 toward first side 12 at the same angle Δ, allowing the user to easily insert their fingers beneath second inner flanges 50 and into second inner recesses 62. It is understood that "sloped" does not require that the outer walls 72, 82 are flat surfaces, but only that the walls 72, 82 extend both radially and axially. In the embodiments of FIGS. 1-9, the outer walls 72, 82 of the first slots 22 are sloped with respect to the first and second sides 12, 14 to extend radially inward and axially from the first side 12 to the first outer flanges 70, and the outer walls 82 of the second slots 24 are sloped with respect to the first and second sides 12, 14 to extend radially inward and axially from the second side 14 to the second outer flanges 80.

Figure 5A:
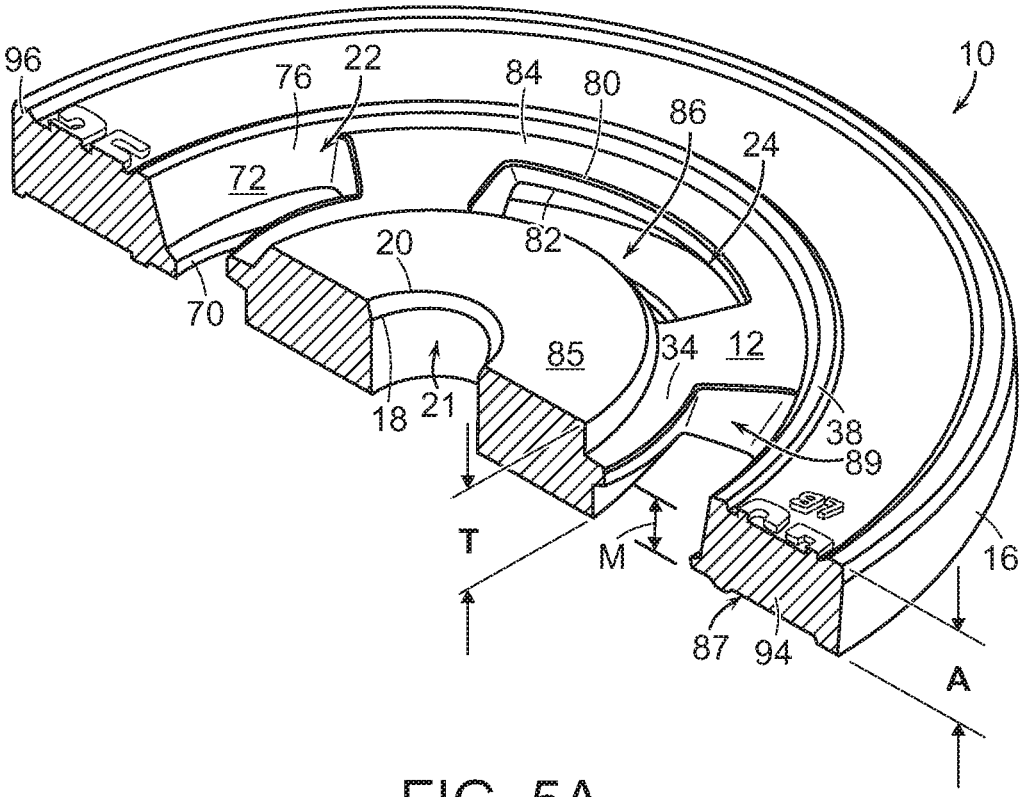
FIG. 5A is a section view of the weight plate of FIG. 1.

In certain embodiments, as seen in FIG. 5A, weight plate 10 may include an annular inner section 85 that surrounds insert aperture 21, an annular outer section 87 that forms an outer periphery of weight plate 10, and an annular middle section 89 that extends radially between annular inner section 85 and annular outer section 87. Each of first slots 22, second slots 24, first and second outer flanges 30, 50, and first and second outer flanges 70, 80 may be positioned within annular middle section 89. Annular inner section 85 may have an axial thickness T, annular outer section 87 may have an axial thickness A, and annular middle section 89 may have an axial thickness M. Axial thickness M may be less than both axial thickness T and axial thickness A such that annular inner section 85, annular outer section 87, and annular middle section 89 are defined by transitions in axial thickness.

Figure 6:
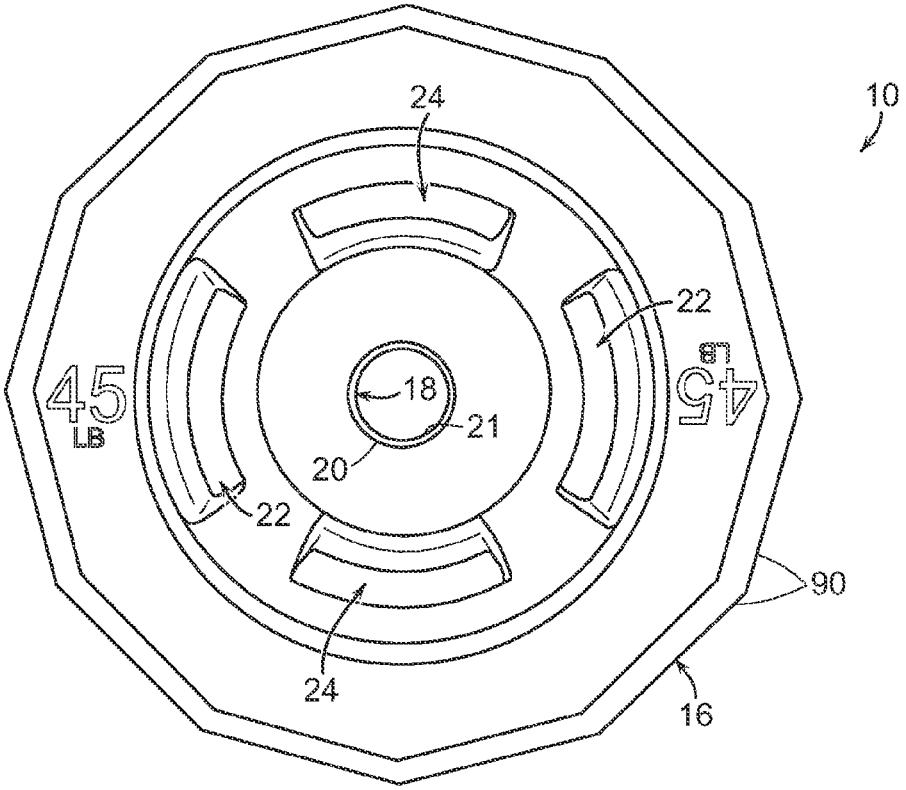
FIG. 6 is a plan view of an alternative embodiment of the weight plate of FIG. 1.

As noted above, in certain embodiments, peripheral edge 16 of weight plate 10 is not circular in shape. Rather, peripheral edge 16 may be formed as a polygonal shape with a plurality of linear segments or sides 90, as shown in FIG. 6. In the illustrated embodiment, peripheral edge 16 includes twelve linear segments 90 to provide a twelve sided weight plate 10. Forming peripheral edge 16 with linear segments 90 allows weight plate 10 to resist circumferential rolling when it is seated on its peripheral edge, such as when weight plates 10 are mounted on a bar for weightlifting, and the bar with weights is placed on the floor. It is to be appreciated that peripheral edge 16 can be configured with a polygonal shape that includes more or less than twelve linear segments 90, and that this is merely an illustrative example of forming peripheral edge 16 as a polygonal shape with a plurality of linear segments 90.

Figure 7:
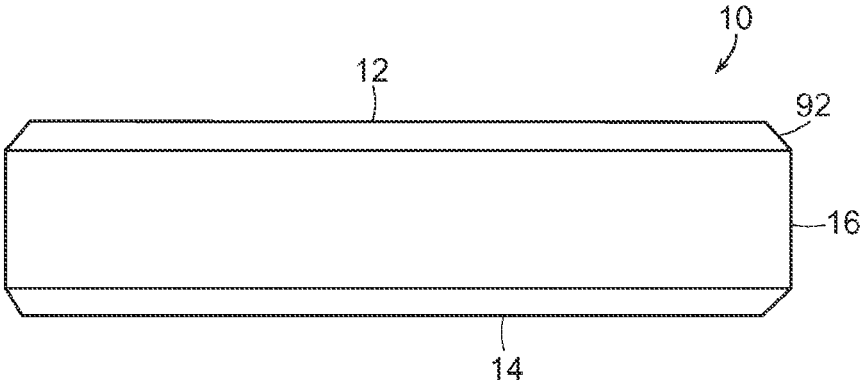
FIG. 7 is an elevation view of the weight plate of FIG. 1.
Figure 8:
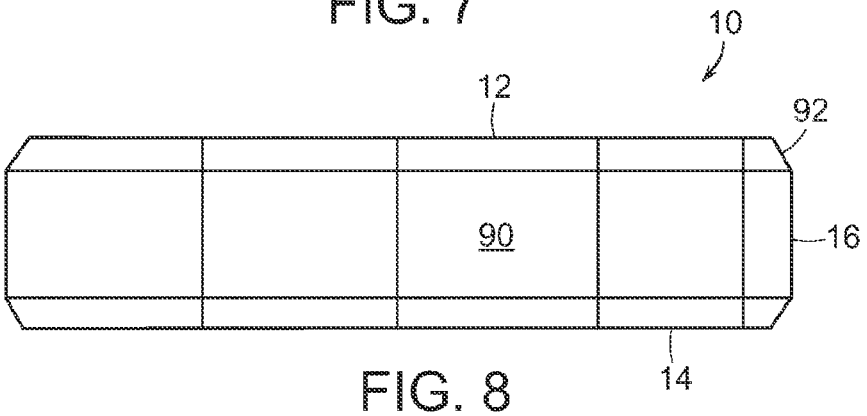
FIG. 8 is an elevation view of the weight plate of FIG. 6.

In certain embodiments, as illustrated in FIGS. 7-8, peripheral edge 16 may include a bevel 92 on first side 12 and second side 14. In certain embodiments, bevel 92 may be at an angle of approximately 45°.

Figure 9:
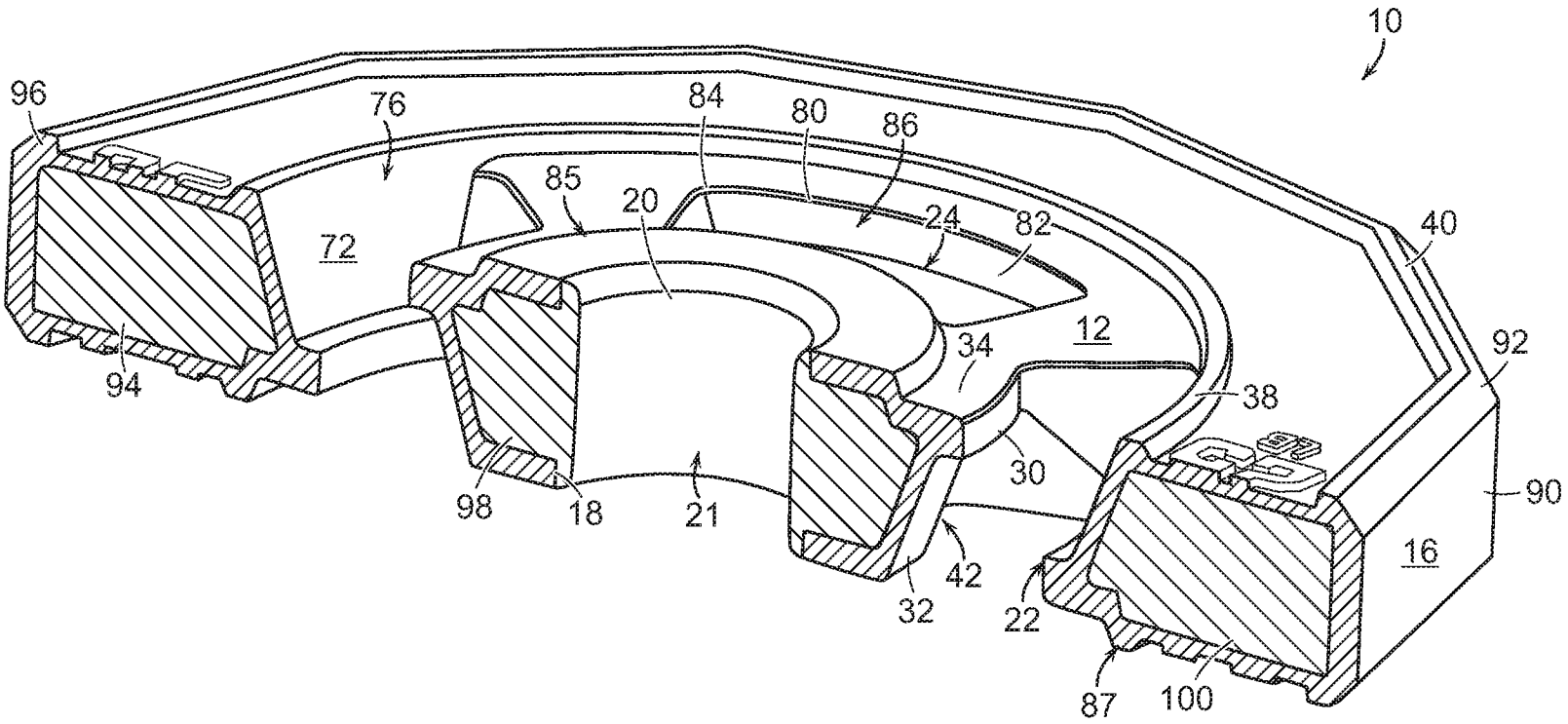
FIG. 9 is a section view of an alternative embodiment of the weight plate of FIG. 1.
Figure 9A:
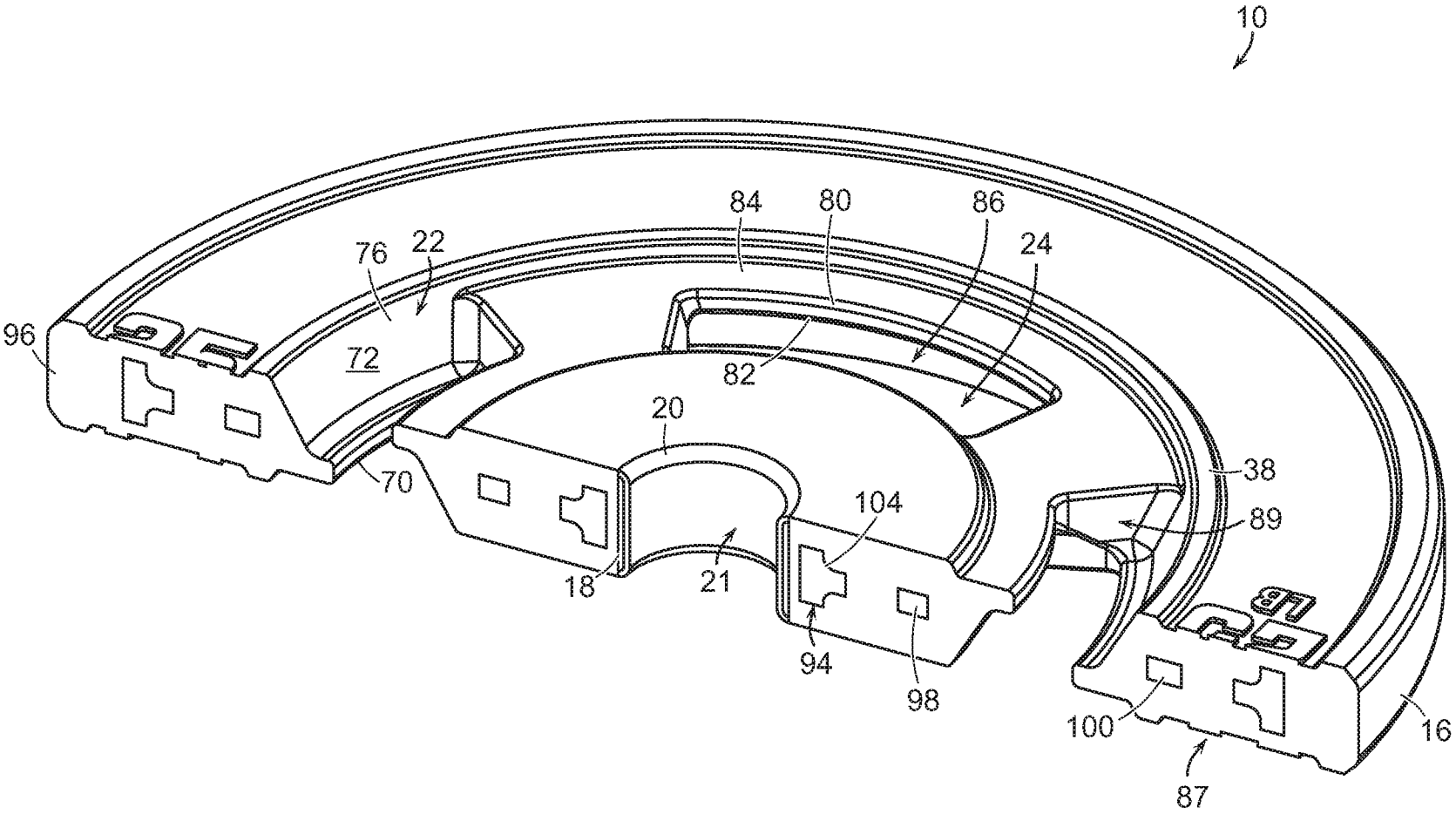
FIG. 9A is a section view of another alternative embodiment of the weight plate of FIG. 1.
Figure 9B:
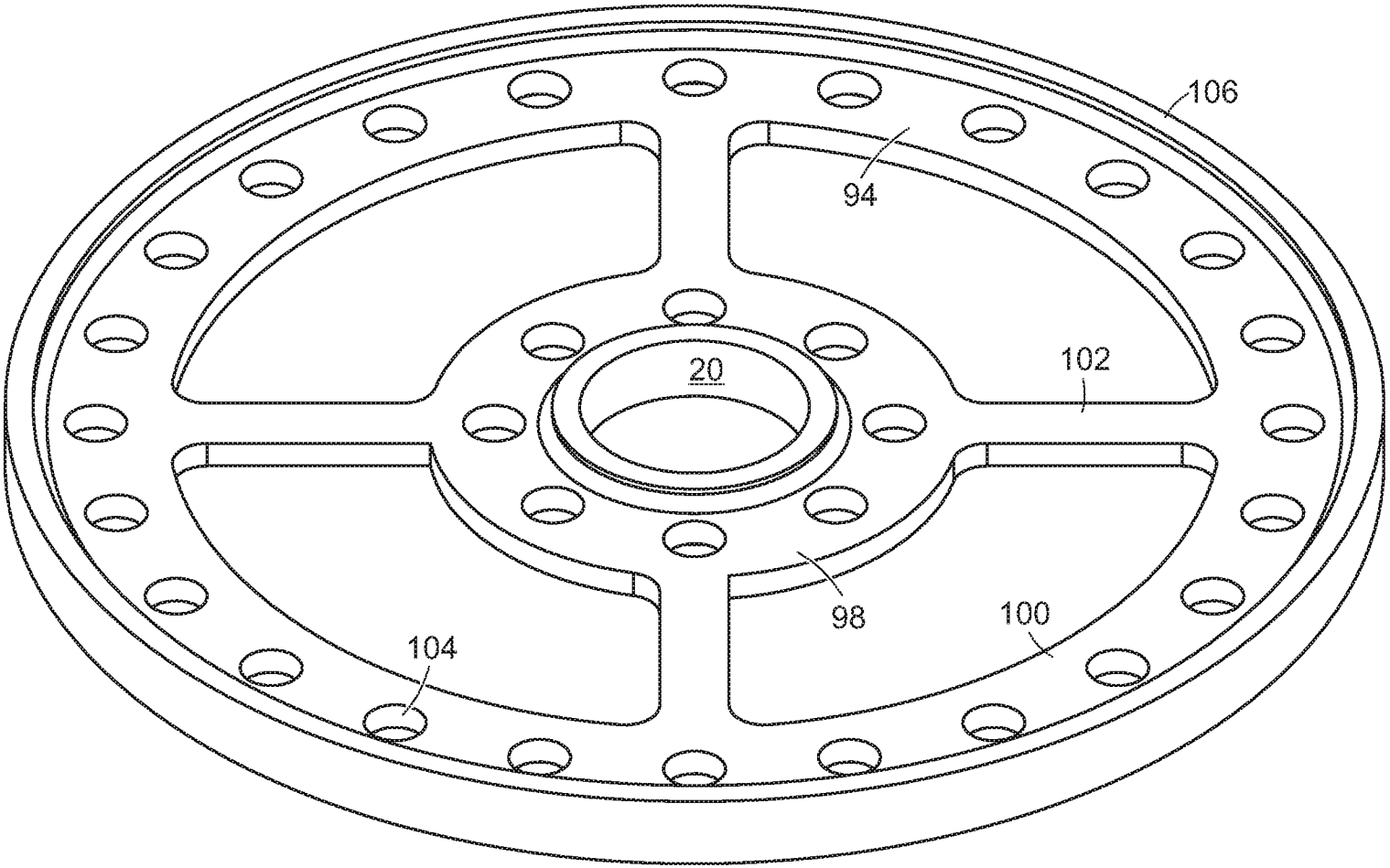
FIG. 9B is a perspective view of the inner core of the weight plate of FIG. 9A.
Figure 9C:
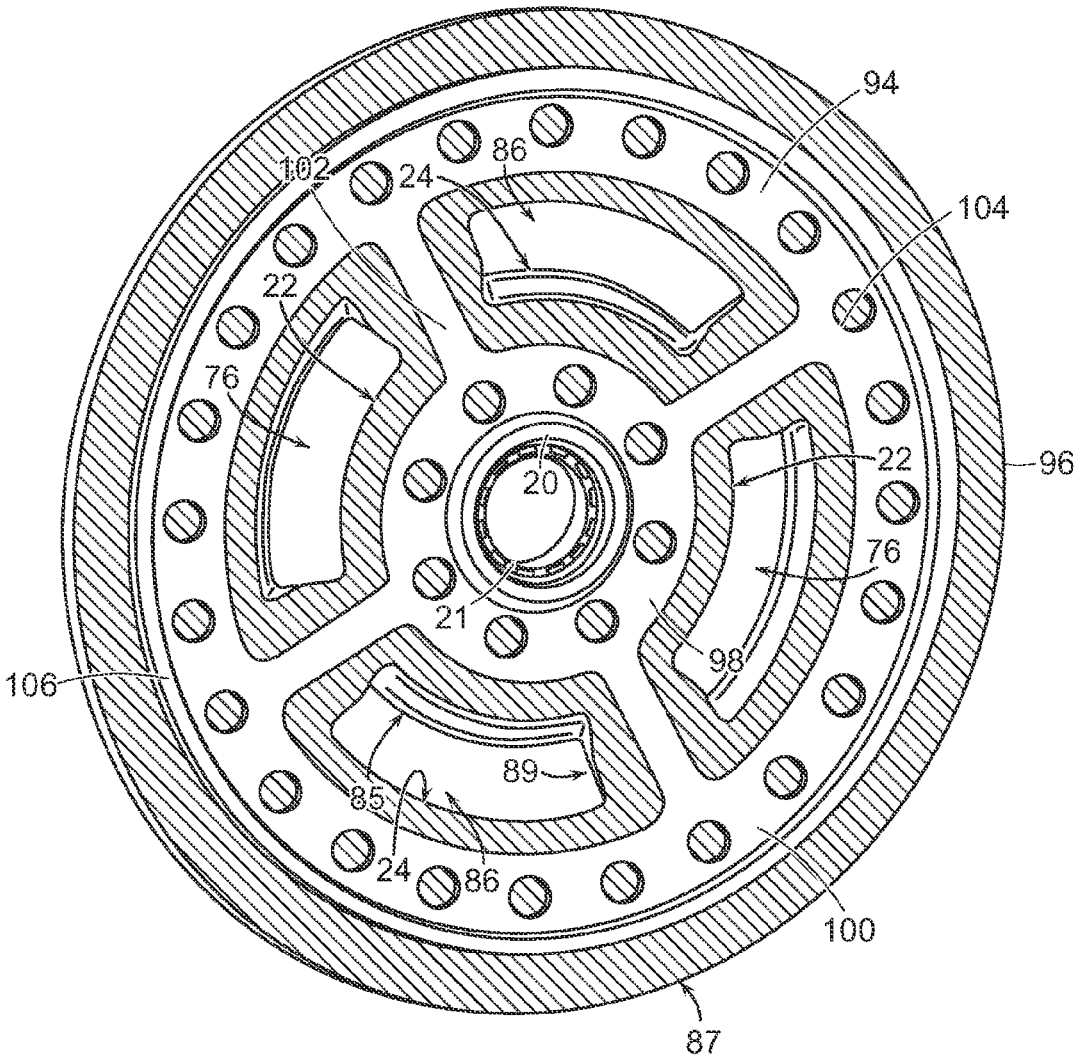
FIG. 9C is a perspective view, partially broken away, of the weight plate of FIG. 9A.

In certain embodiments, as illustrated in FIGS. 9-9C, weight plate 10 may be formed with an inner core 94, which is completely surrounded or encased by an outer coating 96. In certain embodiments, inner core 94 may be a metal, such as cast iron, for example. Outer coating 96 may be formed of polyurethane, urethane, or rubber, for example. As illustrated here, inner core 94 may be substantially covered with outer coating 96. In certain embodiments, outer coating 96 may have a thickness between approximately 4 mm and approximately 8 mm, and, more particularly, approximately 6 mm.

In certain embodiments, as illustrated in FIGS. 9-9C, inner core 94 may be formed of an inner portion in the form of an annular inner ring 98 and an outer portion in the form of an annular outer ring 100. In the embodiment of FIGS. 9A-9C, the inner core 94 also includes a plurality of spokes 102 that extend between and connect annular inner ring 98 and annular outer ring 100. In the illustrated embodiments, annular inner ring 98 is positioned within annular inner section 85, annular outer ring 100 is positioned within annular outer section 87, and spokes 102 are positioned within annular middle section 89. In the embodiment of FIGS. 9A-9C, where weight plate 10 is configured with two slots 22 and two slots 24, there are four spokes 102, each of which is positioned within annular middle section 89 between a slot 22 and an adjacent slot 24. It is understood that the inner core 94 in the embodiment of FIG. 9 may include similarly configured spokes 102 as well.

In the embodiment of FIG. 9, the insert 20 and the inner ring 98 of the inner core 94 are formed as a unitary, monolithic element of one-piece construction. It is to be appreciated that in other embodiments, inner ring 98 and insert 20 may be formed as separate elements, such as illustrated in FIGS. 9A-9C. In the embodiment illustrated in FIGS. 9A-C, inner ring 98, spokes 102, and outer ring 100 are formed as a unitary, monolithic element of one-piece construction. It is to be appreciated that in other embodiments, each of inner ring 98, spokes 102, and outer ring 100 could be formed as a separate element. In yet further embodiments, any two or more of the group of insert 20, inner ring 98, spokes 102, and outer ring 100 could be formed as a unitary, monolithic element of one-piece construction separate from other elements of the group of insert 20, inner ring 98, spokes 102, and outer ring 100. It is also to be appreciated that inner core 94 may not include one or more of inner ring 98, spokes 102, and/or outer ring 100.

Inner core 94 may also include a plurality of apertures 104 that extend through inner core 94, with the material of outer coating 96 filling apertures 104 when weight plate 10 is formed. Apertures 104 may serve to reduce the weight of weight plate 10, while ensuring that inner core 94 and outer coating 96 are securely fixed with respect to one another.

In certain embodiments, a rim 106 may be positioned along and extend axially outward from both sides of inner core 94. In other embodiments, rim 106 may extend outwardly from only a single side of inner core 94. In yet other embodiments, inner core 94 may not include a rim 106.

In further embodiments, the weight plate 10 may generally be configured with two or more first and second slots 22, 24, or four or more first and second slots 22, 24, where each slot 22, 24 extends from the first side 12 to the second side 14. In this embodiment, each slot 22, 24 has two flanges 30, 50, 70, 80 extending into the slot 22, 24, with one flange 50, 70 spaced toward the second side 14 from the first side 12 and the other flange 30, 80 spaced toward the first side 12 from the second side 14. In this configuration, the flanges 50, 70 spaced from the first side 12 may be easily gripped by the user when the first side 12 is resting against a surface (e.g., the ground), and the flanges 30, 80 spaced from the second side 14 may be easily gripped by the user when the second side 14 is resting against a surface. The slots 22, 24 may be organized into opposed pairs that are located on opposite sides of the central aperture 18, such that the slots 22, 24 of each pair have flanges 30, 50, 70, 80 that are symmetrical with each other. The slots 22, 24 and flanges 30, 50, 70, 80 may be configured as shown in FIGS. 1-9 or may be configured differently while including these general structures.

Various embodiments of weight plates have been described herein, which include various components and features. In other embodiments, the weight plates may be provided with any combination of such components and features. It is also understood that in other embodiments, the various devices, components, and features of the weight plates described herein may be constructed with similar structural and functional elements having different configurations, including different ornamental appearances.

Those having skill in the art, with the knowledge gained from the present disclosure, will recognize that various changes can be made to the disclosed apparatuses and methods in attaining these and other advantages, without departing from the scope of the present disclosure. As such, it should be understood that the features described herein are susceptible to modification, alteration, changes, or substitution. For example, it is expressly intended that all combinations of those elements and/or steps which perform substantially the same function, in substantially the same way, to achieve the same results are within the scope of the embodiments described herein. Substitutions of elements from one described embodiment to another are also fully intended and contemplated. The specific embodiments illustrated and described herein are for illustrative purposes only, and not limiting of that which is set forth in the appended claims. Other embodiments will be evident to those of skill in the art. It should be understood that the foregoing description is provided for clarity only and is merely exemplary. The spirit and scope of the present disclosure is not limited to the above examples, but is encompassed by the following claims.

What is claimed is:

1. A weightlifting apparatus comprising:

a weight plate having a first side and an opposed second side;

a central aperture extending through the weight plate from the first side to the second side;

a pair of first slots extending through the weight plate from the first side to the second side and defining a periphery having an inner wall and an outer wall spaced from the inner wall, wherein the central aperture is positioned between the first slots;

a first inner flange extending radially outwardly from the inner wall of each first slot on the first side of the weight plate;

a first outer flange extending radially inwardly from the outer wall of each first slot on the second side of the weight plate; and a pair of second slots extending through the weight plate from the first side to the second side and defining a periphery having an inner wall and an outer wall spaced from the inner wall, wherein the central aperture is positioned between the second slots;

a second inner flange extending radially outwardly from the inner wall of each second slot on the second side of the weight plate; and a second outer flange extending radially inwardly from the outer wall of each second slot on the first side of the weight plate.

2. The weightlifting apparatus of claim 1, wherein the first and second slots are arcuate slots, such that the inner and outer walls of the first slots are arcuate, and the inner and outer walls of the second slots are arcuate.

3. The weightlifting apparatus of claim 2, wherein the first inner and outer flanges and the second inner and outer flanges of each of the first and second slots are arcuate flanges extending along the the respective arcuate slot.

4. The weightlifting apparatus of claim 1, further comprising an insert received in the central aperture, wherein the insert includes an insert aperture extending therethrough.

5. The weightlifting apparatus of claim 4, wherein the weight plate is formed at least partially of one of urethane and rubber, and the insert is formed of metal.

6. The weightlifting apparatus of claim 1, wherein the weight plate comprises an inner core and an outer coating surrounding the inner core.

7. The weightlifting apparatus of claim 6, wherein the inner core is formed of cast iron and the outer coating is formed of polyurethane.

8. The weightlifting apparatus of claim 1, wherein the inner walls of the first slots are sloped with respect to the first and second sides to extend radially outward and axially from the second side to the respective first inner flanges, and the inner walls of the second slots are sloped with respect to the first and second sides to extend radially outward and axially from the first side to the respective second inner flanges.

9. The weightlifting apparatus of claim 8, wherein the outer walls of the first slots are sloped with respect to the first and second sides to extend radially inward and axially from the first side to the respective first outer flanges, and the outer walls of the second slots are sloped with respect to the first and second sides to extend radially inward and axially from the second side to the respective second outer flanges.

10. The weightlifting apparatus of claim 1, wherein the pair of first slots and the pair of second slots are positioned radially outwardly of the central aperture.

11. The weightlifting apparatus of claim 1, wherein the first inner flanges of the first slots and the second outer flanges of the second slots are flush with at least a portion of the first side of the weight plate.

12. The weightlifting apparatus of claim 1, wherein the first outer flanges of the first slots and the second inner flanges of the second slots are flush with at least a portion of the second side of the weight plate.

13. The weightlifting apparatus of claim 1, wherein ends of each of the first and second slots extend radially along the weight plate.

14. The weightlifting apparatus of claim 1, wherein the first slots are offset 90° from the second slots with respect to the central aperture.

15. The weightlifting apparatus of claim 1, wherein the weight plate has a circular outer periphery.

16. The weightlifting apparatus of claim 1, wherein the weight plate has a polygonal outer periphery with a plurality of sides.

17. The weightlifting apparatus of claim 1, further comprising a bevel at a radially outer peripheral edge of each of the first side and the second side.

18. The weightlifting apparatus of claim 1, wherein the first inner flange and the second inner flange of each of the pair of first slots and each of the pair of second slots, and the first outer flange, and the second outer flange of each of the pair of first slots and each of the pair of second slots are rounded over where the first inner flange, the second inner flange, the first outer flange, and the second outer flange, respectively, meet the first and second side.

19. A weightlifting apparatus comprising:

a weight plate having an outer coating formed at least partially of one of urethane and rubber and having a first side and an opposed second side;

a central aperture extending through the weight plate from the first side to the second side;

a metal insert received in the central aperture and having an insert aperture extending therethrough;

a pair of first slots extending through the weight plate from the first side to the second side and defining a periphery having an inner wall and an outer wall spaced from the inner wall, wherein the central aperture is positioned between the first slots, and the first slots are symmetrical with respect to the central aperture;

a first inner flange extending radially outwardly from the inner wall of each first slot on the first side of the weight plate;

a first outer flange extending radially inwardly from the outer wall of each first slot on the second side of the weight plate; and a pair of second slots extending through the weight plate from the first side to the second side and defining a periphery having an inner wall and an outer wall spaced from the inner wall, wherein the central aperture is positioned between the second slots, and the second slots are symmetrical with respect to the central aperture;

a second inner flange extending radially outwardly from the inner wall of each second slot on the second side of the weight plate; and a second outer flange extending radially inwardly from the outer wall of each second slot on the first side of the weight plate.

20. The weightlifting apparatus of claim 19, wherein the weight plate has an annular outer section forming an outer periphery of the weight plate, an annular inner section surrounding the central aperture, and an annular middle section extending radially between the inner and outer sections, wherein the inner section and the outer section have greater axial thicknesses than the middle section, such that the outer, middle, and inner sections are defined by transitions in axial thickness.

21. The weightlifting apparatus of claim 20, wherein the pair of first slots, the pair of second slots, the first and second inner flanges, and the first and second outer flanges are positioned in the middle section.

22. A weightlifting apparatus comprising:

a weight plate having a first side and an opposed second side and a central aperture extending through the weight plate from the first side to the second side, the weight plate having an annular outer section forming an outer periphery of the weight plate, an annular inner section surrounding the central aperture, and an annular middle section extending radially between the inner and outer sections, wherein the inner section and the outer section have greater axial thicknesses than the middle section, such that the outer, middle, and inner sections are defined by transitions in axial thickness;

a pair of first slots extending through the middle section of the weight plate from the first side to the second side, each of the first slots defining a periphery having an inner wall and an outer wall that are arcuately shaped and spaced from one another, wherein the central aperture is positioned between the first slots, and the first slots are symmetrical with respect to the central aperture;

a first inner flange extending radially outwardly from the inner wall of each first slot on the first side of the weight plate, wherein the inner walls of the first slots are sloped with respect to the first and second sides to extend radially outward and axially from the second side to the respective first inner flanges;

a first outer flange extending radially inwardly from the outer wall of each first slot on the second side of the weight plate, wherein the outer walls of the first slots are sloped with respect to the first and second sides to extend radially inward and axially from the first side to the respective first outer flanges; and a pair of second slots extending through the middle section of the weight plate from the first side to the second side, each of the first slots defining a periphery having an inner wall and an outer wall that are arcuately shaped and spaced from one another, wherein the central aperture is positioned between the second slots, and the second slots are symmetrical with respect to the central aperture;

a second inner flange extending radially outwardly from the inner wall of each second slot on the second side of the weight plate, wherein the inner walls of the second slots are sloped with respect to the first and second sides to extend radially outward and axially from the first side to the respective second inner flanges; and a second outer flange extending radially inwardly from the outer wall of each second slot on the first side of the weight plate, wherein the outer walls of the second slots are sloped with respect to the first and second sides to extend radially inward and axially from the second side to the respective second outer flanges.

* * * * *